United States Patent [19]

Murphy

[11] Patent Number: 4,482,098

[45] Date of Patent: Nov. 13, 1984

[54] FEED CHOPPING KNIFE

[76] Inventor: Charles J. Murphy, Route #1, Abilene, Kans. 67410

[21] Appl. No.: 365,370

[22] Filed: Apr. 5, 1982

[51] Int. Cl.[3] ..... B02C 18/18

[52] U.S. Cl. ..... 241/292.1; 56/294; 30/240

[58] Field of Search ..... 30/351, 357, 346, 347, 30/240; 241/292.1, 300.1, 301; 56/294

[56] References Cited

U.S. PATENT DOCUMENTS

| | | | |
|---|---|---|---|
| 838,521 | 12/1906 | Case | 56/294 |
| 2,185,833 | 1/1940 | Clemson | 56/294 |
| 2,469,730 | 5/1949 | Hutchinson | 56/294 |
| 2,860,475 | 11/1958 | Richard | 56/294 |
| 3,332,147 | 7/1967 | Legge | 30/240 |
| 3,805,660 | 4/1974 | Burrough | 241/292.1 X |
| 3,974,969 | 8/1976 | Herbst | 241/292.1 X |
| 3,979,075 | 9/1976 | Heron | 241/292.1 X |

*Primary Examiner*—Jimmy C. Peters
*Attorney, Agent, or Firm*—Edwin H. Crabtree

[57] ABSTRACT

An improved feed chopping knife for mounting on a rotating feed chopping cutter head and engaging a cutter bar. The knife having a groove cut therein and along the length of the front of the knife thereby reducing the surface area of a beveled cutting edge and causing less drag when the knife engages the cutting bar. Also, the knife provides the feature of discharging the cut feed away from the cutter head thereby eliminating feed clogging the interior of the cutter head.

6 Claims, 6 Drawing Figures

FEED CHOPPING KNIFE

BACKGROUND OF THE INVENTION

This invention relates to a feed chopping knife and more particularly to a feed chopping knife mounted on a rotating feed chopping cutter head for reducing drag when the knife contacts a cutter bar and discharging feed away from the center of the rotating cutter head.

Rotating feed cutter head by design often throw the cut feed inside the head causing clogging or bunching therein. Cupped vanes have been added to the knives to centrifugally throw the cut crop away from the head and toward a blower. Adding the cupped vanes requires additional cost and maintenance.

Heretofore, there have been various types of chopping and cutting knives described in U.S. Pat. No. 383,521 to Case, U.S. Pat. No. 924,318 to Case, U.S. Pat. No. 905,591 to Rowe, U.S. Pat. No. 374,808 to Passmore and U.S. Pat. No. 2,495,812 to Hutchinson. None of the above mentioned patents describe nor disclose the unique structure and advantages of the improved feed chopping knife as described herein. Also the reference mentioned in U.S. Pat. No. 4,031,670 issued to the inventor of the subject feed chopping knife are incorporated by reference.

SUMMARY OF THE INVENTION

The improved feed chopping knife reduces the surface area of the heel of the knife thereby reducing drag of the rotating feed chopping cutter head when it engages the cutter bar and in turn requiring less horsepower in driving the cutter head and lower fuel cost.

The improved feed chopping knife because of its design causes the cut feed to the discharge away from the center of the rotating feed chopping cutter head and holds the grain against a recutter screen used with feed chopping equipment thereby providing a finer chopping of the feed.

The knife is simple in design, rugged in construction, can be added to existing cutter heads and does not require the addition of cupped vanes.

The improved feed chopping knife for mounting on a rotating feed chopping cutter head and adapted for engaging a cutter bar includes an elongated metal bar having a front, rear, sides and a beveled cutting edge along the length thereof. The cutting edge is beveled upwardly from the rear of the bar to the front of the bar. A groove is cut in the front of the bar and along the length thereof. The groove reduces the surface area of the cutting edge which normally contact the cutter bar.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
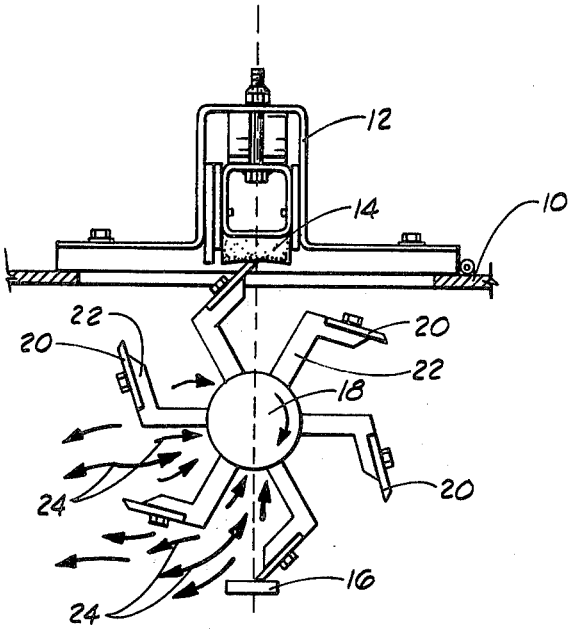
FIG. 1 PRIOR ART

In FIG. 1 a standard feed chopping box 10 is shown in cross-section with a pivotally mounted stone housing 12 having a sharpening stone 14 mounted therein. Also attached to the box 10 is a cutter bar 16. Rotatably mounted in the box 10 is a rotating feed chopping cutter head 18 having a plurality of prior art feed chopping knives 20 mounted on cutter head arms 22. As the feed chopping cutter head 18 rotates therein the knives 20 engage the feed to be cut as the knives 20 rotate past the cutter bar 16. Heretofore, as the feed represented by arrows 24 is cut, part of the feed through centrifigal force is discharged away from the rotating head 18 but a portion of the cut feed 24 moves inwardly toward the center of the head causing bunching or clogging of the feed inside the rotating head 18.

Figure 3:
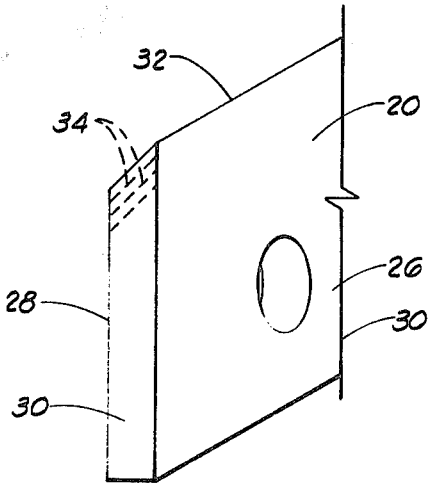
FIG. 3 PRIOR ART
FIG. 3 and FIG. 6 illustrate prior art cutting knives with the cutting knives mounted on a rotating feed chopping cutter head shown in FIG. 1.

In FIG. 3 an enlarged view of the prior art feed chopping knives 20 is shown. The knife 20 includes a front 26, a rear 28, sides 30 and a beveled cutting edge 32 which is beveled upwardly from the rear 28 to the front 26 of the knives 20 which is an elongated metal bar. The dotted lines 34 are shown to represent a typical wear pattern of the beveled cutting edge 32 caused by engaging and cutting the feed between the cutter bar 16.

Figure 6:
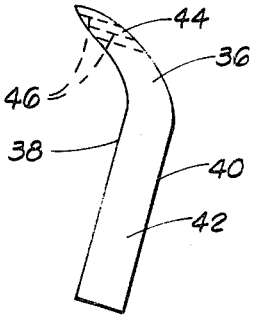
FIG. 6 PRIOR ART

In FIG. 6 a prior art feed chopping knife 36 is shown. This knife 36 is also an elongated metal bar and is popularly known as a "J" knife. The "J" knife 36 also includes the front 38, a rear 40, sides 42 and a "J" shaped cutting surface 44. The wear pattern is indicated by dotted lines 46.

Heretofore, when the "J" knife 36 hit a foreign object such as a rock or the like, the knife 36 would flex and expand in size causing the diameter of the cutter head 18 to expand in size causing the head 18 to self destruct against the cutter bar 16.

Figure 2:
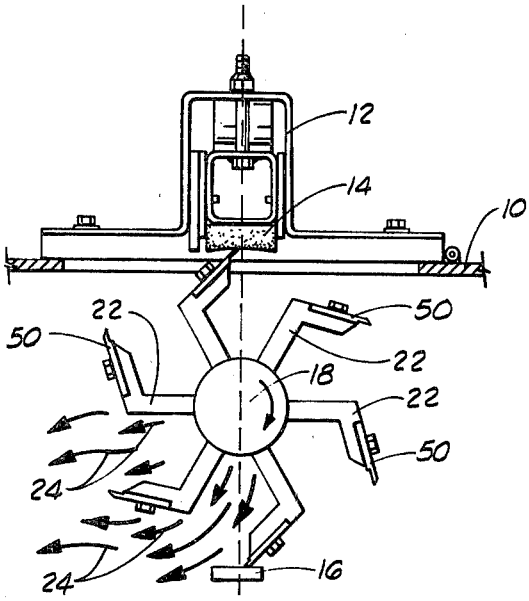

In FIG. 2 the same feed chopping box 10 is shown with the pivotally mounted stone housing 12 and sharpening stone 14 mounted thereon. But in this figure, the rotating feed chopping head 18 includes the new improved feed chopping knife 50 mounted on the cutter head arms 22. It should be noted from reviewing FIG. 2, because of the improvement in the knife 50, the cut feed represented by arrows 24 now is discharged away from the inner circumference of the rotating head 18 to prevent the bunching or clogging of the feed in and around the center of the cutter head 18. Also when a recutter screen is used in conjunction with the cutter head 18 the feed as it is thrown away from the cutter head 18 and against the recutter screen, a finer chopping of the feed is provided.

Figure 4:
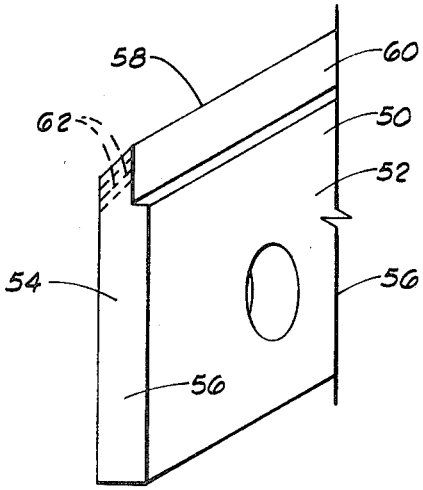
FIG. 4 and FIG. 5 illustrate the improved feed chopping knife with the knife mounted on a rotating feed chopping cutter head shown in FIG. 2.

In FIG. 4 the improved feed chopping knife 50 includes a front 52, a rear 54, sides 56 and a beveled cutting edge 58. But unlike the prior art knife 20, a groove 60 is cut in the front of the metal bar perpendicular thereto and along the length thereof. The groove 60 reduces the surface area of the beveled cutting edge 58 normally contacting the cutter bar 16 thereby causing less drag there against. Typically the groove 60 is from one-half to one inch in depth and the wear pattern of the beveled edge 58 is illustrated by dotted lines 62. Also because of the design of the groove 60 in the front 52 of the knife 50, a cupping action results in the lifting and discharging of the cut feed away from the cutter head 18 as the knives 50 rotate past the cutter bar 16.

Figure 5:
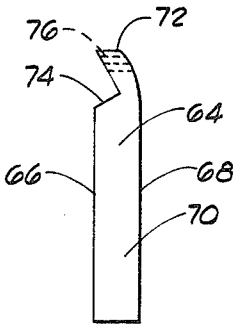

In FIG. 5, an alernate embodiment of the improved knife 50 is shown and designated by reference numeral 64. The improved knife 64 is provided to eliminate the use of the "J" knife 36 as shown in FIG. 6. The knife 64 includes a front 66, a rear 68, sides 70 and beveled cutting surface 72. In the front 66 of the improved knife 64 is a groove 74 cut therein to again reduce a beveled cutting surface area of the knife 64. The wear pattern lines of the beveled surface 72 are shown as dotted lines 76. This new design as illustrated in FIG. 5 provides the unique features in that it is rigid and spreads the load onto the cutter head arms 22 and does not increase in diameter thereby reducing wear and tear on the feed chopping box 10 should a foreign object be engaged therein.

Changes may be made in the construction and arrangement of the parts or elements of the embodiments as described herein without departing from the spirit or scope of the invention defined in the following claims.

What is claimed is:

1. An improved feed chopping knife for mounting on a rotating feed chopping cutter head and engaging a cutter bar, the knife comprising:

an elongated metal bar having a front surface, a rear surface, side surface and a beveled cutting edge along the length thereof, the cutting edge beveled upwardly from the rear surface of the bar to the front surface of the bar; and a groove cut in the leading edge and in the front surface of the bar and along the length thereof, the groove reducing the surface area of the beveled cutting edge normally contacting the cutter bar.

2. The knife as described in claim 1 wherein the groove is cut perpendicular to the front surface of the bar and extending upwardly to the beveled edge.

3. The knife as described in claim 1 wherein the front and the rear surfaces of the bar are parallel to each other.

4. The knife as described in claim 1 wherein the rear of the bar adjacent the cutting edge curves inwardly toward the front of the bar.

5. The knife as described in claim 4 wherein the groove is cut at an angle to the front surface of the bar.

6. An improved feed chopping knife for mounting on a rotating feed chopping cutter head and engaging a cutter bar, the knife comprising:

an elongated metal bar having a front surface, a rear surface, side surfaces and a beveled cutting edge along the length thereof, the cutting edge beveled upwardly from the rear surface of the bar to the front of the bar, the rear surface of the bar and the front surface of the bar parallel to each other; and a groove cut in the leading edge and in the front surface of the bar and perpendicular to the front surface of the bar and along the length thereof, the groove reducing the surface area of the beveled cutting edge normally contacting the cutter bar.

* * * * *